United States Patent [19]

Deckert

[11] 4,030,845

[45] June 21, 1977

[54] TOOTHBRUSH WITH SELF-CONTAINED DENTIFRICE AND DISPOSABLE HANDLE

[76] Inventor: Dennis D. Deckert, 8550 E. 196th St., Noblesville, Ind. 46060

[22] Filed: May 17, 1976

[21] Appl. No.: 687,347

[52] U.S. Cl. ..... 401/268; 401/132

[51] Int. Cl.[2] ..... A46B 11/00

[58] Field of Search ..... 401/132, 268, 22

[56] References Cited

UNITED STATES PATENTS

| | | | |
|---|---|---|---|
| 3,316,580 | 5/1967 | Tebbs | 401/132 |
| 3,378,870 | 4/1968 | Matsunaga | 401/268 X |
| 3,536,410 | 10/1970 | Wargot | 401/268 X |

*Primary Examiner*—Lawrence Charles
*Attorney, Agent, or Firm*—Woodard, Weikart, Emhardt & Naughton

[57] ABSTRACT

A toothbrush having a removable brush which includes dentifrice applied to the bristles of the brush. An elongated base is removably mounted to one end of a toothbrush handle. The handle may be disposable and reusable. A plurality of upstanding straight flexible bristles extend upright from the top surface of the base and are arranged in a plurality of spaced apart rows. A plurality of flexible loop-configured bristles are fixedly mounted to the base and extend upwardly from the top surface thereof being arranged in lines interspaced between the rows of straight bristles. Each loop-configured bristle defines and encloses an area in which dentifrice is positioned. In one embodiment, adhesive is provided to secure the base to the handle whereas in another configuration, a pair of opposed clips mounted to the handle are removably engaged with the opposite ends of the base.

7 Claims, 6 Drawing Figures

TOOTHBRUSH WITH SELF-CONTAINED DENTIFRICE AND DISPOSABLE HANDLE

BACKGROUND OF THE INVENTION

1. Field of the Invention

This invention is in the field of toothbrushes.

2. Description of the Prior Art

A variety of U.S. patents have been granted for toothbrushes having disposable bristles and/or self-contained dentifrice. For example, both of the U.S. Pat. Nos. 2,550,190 issued to A. Greenberg and 3,536,410 issued to J. S. Wargoe disclose toothbrushes wherein the dentifrice is in a special compartment adjacent to the bristles. A similar toothbrush is disclosed in the U.S. Pat. No. 3,292,644 issued to R. E. Ericson wherein the dentifrice is positioned in a cavity within the handle with the brush head being removable from the handle. The dentifrice may also be applied to the bristles of the brush such as shown in the U.S. Pat. Nos. 3,378,870 issued to Matsunaga and 3,691,585 issued to Flom. In the Flom device, the dentifrice is sprayed on the bristles. Another approach is disclosed in U.S. Pat. No. 3,491,396 issued to Eannarino et al. wherein the toothbrush includes a soft-toothed brushing surface having voids through which the dentifrice flows.

Disclosed herein is yet another toothbrush which includes the feature of a disposable brush head which is easily attachable to the toothbrush handle. In addition, the brush is provided with special bristles to effectively hold a sufficient quantity of dentifrice which is released from the bristles upon application of water and as a result of the scrubbing action of the bristles against the teeth.

SUMMARY OF THE INVENTION

One embodiment of the present invention is a teeth-cleaning device comprising a base having an elongated configuration and further having a top surface and a bottom surface, a plurality of upstanding and straight bristles fixedly mounted to the base and extending outwardly from the top surface being flexible and resilient and arranged in a plurality of spaced apart and parallel rows, a plurality of flexible and resilient loop-configured bristles fixedly mounted to the base and extending outwardly from the top surface being arranged in a plurality of spaced apart and parallel lines interspaced between and separating apart the rows, the loop-configured bristles each having an outer rounded distal end with a pair of legs extending therefrom toward and attached to the base, the legs being spaced apart defining a dentifrice-holding area with one of the legs being severed between the distal end and the base allowing release of the dentrifice, and dentifrice means positioned on the loop-configured bristles within the holding area and being operable to release onto teeth when rubbed against the teeth in the presence of a liquid release agent.

It is an object of the present invention to provide a new and improved toothbrush.

A further object of the present invention is to provide a new and improved teeth-cleaning device wherein means are provided for holding a sufficient quantity of releasable dentifrice.

Related objects and advantages of the present invention will be apparent from the following description.

DESCRIPTION OF THE PREFERRED EMBODIMENTS

Figure 1:
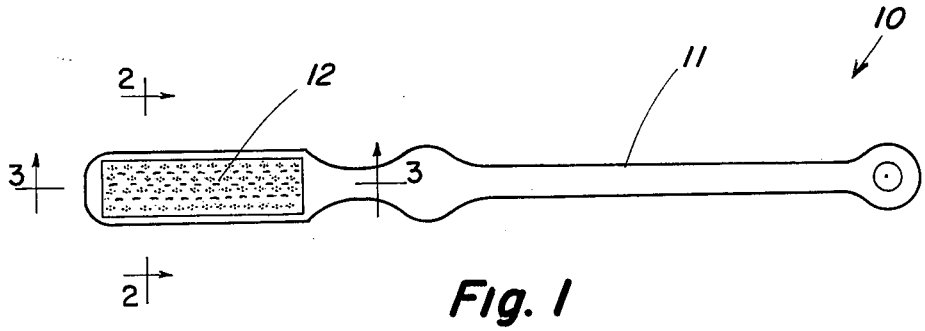
FIG. 1 is a plan view of a toothbrush incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
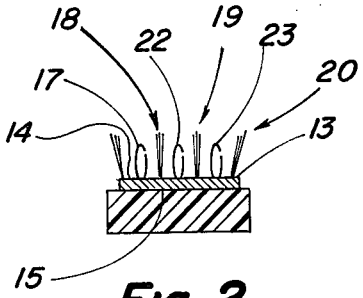
FIG. 2 is an enlarged cross-sectional view taken along the line 2—2 of FIG. 1 and viewed in the direction of the arrows.
Figure 3:
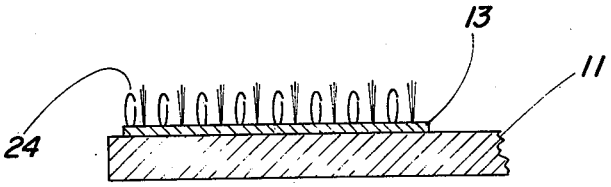
FIG. 3 is an enlarged cross-sectional view taken along the line 3—3 of FIG. 1 and viewed in the direction of the arrows.

Referring now more particularly to the drawings, there is disclosed a toothbrush 10 having a handle portion 11 and a brush 12 mounted thereon. Brush 12 includes a base 13 (FIG. 2) having an elongated configuration with a top surface 14 and a bottom surface 15. A plurality of upstanding and straight bristles and a plurality of flexible and resilient loop-configured bristles are fixedly mounted to base 13 and extend outwardly from top surface 14.

The straight bristles are flexible and resilient and are arranged in a plurality of spaced apart and parallel rows. For example, in the embodiment shown in FIG. 2, the straight bristles are arranged in rows 18, 19 and 20.

Figure 4:
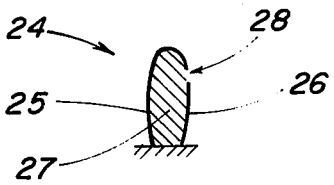
FIG. 4 is an enlarged view of one of the loop-shaped bristles of FIG. 3.

The loop-configured bristles are arranged in a plurality of spaced apart and parallel rows or lines which are interspaced between and separate apart rows 18, 19 and 20. For example, in the embodiment shown in FIG. 2, the loop-configured bristles are arranged in rows 17, 22 and 23. Each of the loop-configured bristles have an outer rounded distal end with a pair of legs extending therefrom and toward and attached to base 13. For example, the loop-configured bristle 24 shown in FIG. 4 has a rounded outer end with a pair of legs 25 and 26 being spaced apart defining a dentifrice-holding area 27. Leg 26 is severed between the distal rounded end and the base at location 28 allowing release of the dentifrice positioned within area 27.

A variety of different types of dentifrice may be applied to the bristles. Likewise, a variety of means may be used to apply the dentifrice to the bristles. For example, the dentifrice, which may be in a powdered form, may be sprayed onto the bristles so as to build up the dentifrice within area 27. As the bristles are rubbed against the teeth and with the application of water, the dentifrice may escape from the bristles with the severed leg 26 assisting the release of the dentifrice by enabling legs 25 and 26 to spread apart a sufficient distance to break the adhesion between the dentifrice and the legs. Many additional techniques of manufacturing may be used to apply the dentifrice to the bristles. For example, the bristles may be dipped in the dentifrice.

Figure 5:
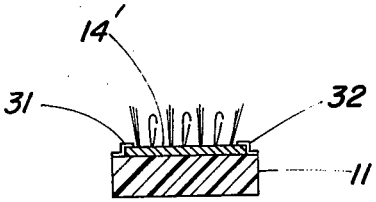
FIG. 5 is the same view as FIG. 3 only showing an alternate embodiment of the means used to secure the brush to the toothbrush handle.
Figure 6:
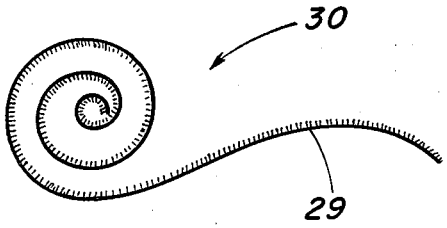
FIG. 6 is a side view of the brush mounted on the handle of FIG. 1 in a stored condition.

The bristles and the base may be initially stored in a spiral configuration 30 such as shown in FIG. 6 with either the bristles extending inwardly or outwardly from the base. A sufficient quantity 29 of the base may be withdrawn from spiral 30 and then severed therefrom with the severed portion then being mounted to the handle and with the remaining spiral portion of the bristles being stored. A variety of means may be utilized to mount the base to handle 11. For example, in one embodiment, adhesive is provided on the bottom surface 15 of the base 13 with the adhesive then securing the base to the handle upon application of pressure. Likewise, the base may be heat fused to the handle. In another embodiment, base 14' is secured to handle 11 (FIG. 5) by a pair of clips 31 and 32 fixedly secured to handle 11 and engageable with the opposite ends of base 14' thereby allowing the base to be removably secured to the handle. Base 14' is identical to base 13 except that base 14' is secured by clips 31 and 32.

Many variations are contemplated and included in the present invention. For example, in one embodiment, straight bristles extend a greater distance from surface 14 than the loop-configured bristles. The straight bristles are provided so as to clean the areas between teeth whereas the curved bristles are used to not only hold dentifrice, but also to polish the front surface of each tooth. As described in the specification, the dentifrice is applied to the loop-configured bristles; however, it is to be understood that the dentifrice may also be applied to the straight-configured bristles.

Bases 13 and 14' may be constructed of a variety of materials. The base should be semi-rigid in construction. By semi-rigid in construction, it is meant that the base should be sufficiently flexible so as to be bowed allowing insertion of said base between the pair of fixedly mounted clips 31 and 32 but sufficiently rigid in construction so as to prevent the accidental disengagement of the base from the clips.

It will be obvious from the above description that the present invention provides a new and improved toothbrush. It will be further obvious from the above description that the present invention provides a new and improved teeth-cleaning device wherein means are provided for removably holding an adequate supply of dentrifice which is released to the teeth upon application of force and liquid.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A teeth-cleaning device comprising:

a base having an elongated configuration and further having a top surface and a bottom surface;

a plurality of upstanding and straight bristles fixedly mounted to said base and extending outwardly from said top surface being flexible and resilient and arranged in a plurality of spaced apart and parallel rows;

a plurality of flexible and resilient loop-configured bristles fixedly mounted to said base and extending outwardly from said top surface being arranged in a plurality of spaced apart and parallel lines interspaced between and separating apart said rows, said loop-configured bristles each having an outer rounded distal end with a pair of legs extending therefrom toward and attached to said base, said legs being spaced apart defining a dentifrice-holding area with one of said legs being severed between said distal end and said base allowing release of said dentifrice; and, dentifrice means positioned on said loop-configured bristles within said holding area and being operable to release onto teeth when rubbed against said teeth in the presence of a liquid release agent.

2. The device of claim 1 and further comprising:

a toothbrush handle with said base mounted thereon and with said straight bristles and said loop-configured bristles forming the brush of said toothbrush handle; and, mounting means operable to fasten said base to said handle.

3. The device of claim 2 wherein said mounting means includes adhesive on said bottom surface of said base.

4. The device of claim 2 wherein:

said base is of semi-rigid construction;

said mounting means includes a pair of opposed clips mounted to said handle with said clips engageable with opposite ends of said base removably securing said base to said handle.

5. The device of claim 1 wherein:

said base is initially stored in a spiral configuration with portions of said base withdrawable from said spiral to be severed therefrom.

6. The device of claim 1 wherein:

said straight bristles extend a greater distance from said top surface of said base than said loop-configured bristles.

7. The device of claim 2 wherein:

said handle is disposable.

* * * * *